United States Patent [19]

Sisler et al.

[11] 3,942,265

[45] Mar. 9, 1976

[54] DRYER CONTROL ARRANGEMENT

[75] Inventors: Robert R. Sisler; Robert C. Helfrich, both of Louisville, Ky.

[73] Assignee: General Electric Company, Louisville, Ky.

[22] Filed: May 9, 1974

[21] Appl. No.: 468,276

[52] U.S. Cl. ..... 34/45; 34/48

[51] Int. Cl.[2] ..... F26B 13/10

[58] Field of Search ..... 34/45, 48; 432/44, 46; 219/400, 486, 487, 364

[56] References Cited

UNITED STATES PATENTS

| | | | |
|---|---|---|---|
| 2,621,423 | 12/1952 | Clark | 34/48 |
| 3,203,679 | 12/1974 | Williams et al. | 34/48 |
| 3,571,941 | 3/1971 | Garfield | 34/48 |
| 3,612,500 | 10/1971 | Cramer et al. | 34/48 |

*Primary Examiner*—Kenneth W. Sprague
*Assistant Examiner*—Larry I. Schwartz

[57] ABSTRACT

A protective control arrangement for a clothes dryer includes a pair of electrical resistance heaters coupled in parallel across a power source. A thermostat is coupled serially with one of the heaters, and is arranged for placement in the dryer exhaust air stream. With such an arrangement, as the clothes approach dryness and a predetermined temperature is reached, the thermostat opens permanently de-energizing one of the heaters, leaving the other heater continuously energized for the remainder of the operational cycle.

6 Claims, 4 Drawing Figures

DRYER CONTROL ARRANGEMENT

BACKGROUND OF THE INVENTION

1. Field of the Invention

The present invention relates to a protective control arrangement for a clothes dryer and more particularly, to such a control arrangement useful in a clothes dryer wherein certain modern fabrics such as polyknits and modacrylics are being dried, for limiting the drying temperature below that at which such fabrics are subject to damage as by shrinking and permanent wrinkling.

2. Description of the Prior Art

It is well known in the art that, in a drying operation, such as that occuring in a clothes dryer, as a particular clothes load becomes dry, a progressively diminishing amount of the thermal energy supplied to the incoming dryer air is converted into latent heat of evaporation of water, while progressively increasing amount of the incoming thermal energy produces a rising exhaust air temperature. It is also known that clothes being dried can withstand more heat while still relatively wet, and further, that the temperature in the clothes dryer reaches the maximum near the end of the drying cycle wherein the clothes approach total dryness. Therefore, by sensing the exhaust air temperature and controlling the thermal energy input in accordance with the measured temperature, a relatively greater amount of thermal energy may be directed to the clothes at the beginning of a drying cycle and a relatively lesser amount near the end thereof thereby resulting in an efficient and non-damaging drying of the clothes load.

During a typical operational cycle wherein clothes made of fabrics such as cottons are being dried, as the load approaches dryness, a control thermostat cycles the total thermal energy source which may and usually does include two heating elements, this resulting in subjecting the garments to temperatures oftentimes in excess of 300° F. Many of today's modern fabrics however such as polyknits, modacrylics and others of the permanent-press type, may be damaged when subjected to temperatures in the area of 225° to 250° F. It is noted here that as long as there is moisture content in and around the fabrics, the fabrics themselves will be limited generally to a maximum temperature of around 212° F. However, it is desirable to limit the temperatures to which these garments are subjected to below those damaging temperatures after the greater portion of the moisture content therein has been removed.

The prior art, such as U.S. Pat. No. 3,612,500—Cramer et al, discloses a control arrangement for a clothes dryer wherein a pair of electrical heating elements are coupled in parallel across a source of electrical power. Coupled serially with each heating element and in parallel with each other are two thermostats, a first of which trips or opens at a lower temperature than the second but which resets or closes at a higher temperature than the second. With such an arrangement then, as the exhaust temperature reaches a predetermined value, the first thermostat opens cutting power from a first heater, the thermostat then becoming coupled serially with the second thermostat such that both heaters are still coupled in parallel across the power source. Upon the reaching of another and higher predetermined temperature, the second thermostat opens to remove power from both heaters, leaving the second heater de-energized for the rest of the operational cycle. The first thermostat then proceeds to cycle allowing the first heater to operate cyclically until the end of the operational cycle.

In U.S. Pat. No. 3,571,941 — Garfield et al, there is disclosed a dryer control circuit wherein two heating elements are coupled in parallel across a power source. In this arrangement, both heaters are energized until a thermostat trips after which time one of the heaters operates cyclically in response to the thermostat's opening and closing while the other heating element operates constantly until the end of the operational cycle. Other arrangements have been disclosed wherein clothes dryers have been provided with automatic control circuits adapted to terminate the drying cycle when a selected dryness level is detected by moisture sensing apparatus. Such a system is disclosed in U.S. Pat. No. 3,522,660—Elders.

While the prior art does show systems for reducing the rate for input of thermal energy, it is nevertheless desirable to provide a protective control arrangement for a clothes dryer which is fairly simple of construction yet which provides the control necessary to prevent damage to certain fabrics such as polyknits.

By the present invention, there is provided such a protective control arrangement which is rather simple of construction, highly reliable and of low cost and which is readily adaptable to use in a dryer wherein gas burners are used as the thermal energy source as well as electrical resistance heaters.

SUMMARY OF THE INVENTION

In accordance with the present invention, there is provided in a clothes dryer having at least one operational cycle for the drying of clothes placed therein, a protective control arrangement. The control arrangement comprises first and second heating means in the dryer energized at the start of the cycle for supplying thermal energy to the dryer for effecting drying of clothes placed therein. Control means are provided in the dryer arranged such that upon reaching a predetermined temperature therein, the control means will become activated to effect de-energization of the first heating means for the remainder of the cycle while the second heating means remains continuously energized for the complete cycle, thereby effecting a reduction of rate of supply of thermal energy to the dryer.

It is an object of the present invention to provide an improved protective control arrangement for a clothes dryer.

It is a further object to provide a relatively low cost and highly simplified protective control arrangement for both electrical and gas clothes drying apparatus.

It is a further object to provide in a clothes dryer a protective control arrangement which permits the use of relatively high thermal energy inputs when the clothes are relatively moist and which reduces the amount of thermal energy applied as the moisture content of the clothes is reduced.

DESCRIPTION OF THE PREFERRED EMBODIMENT

Figure 1:
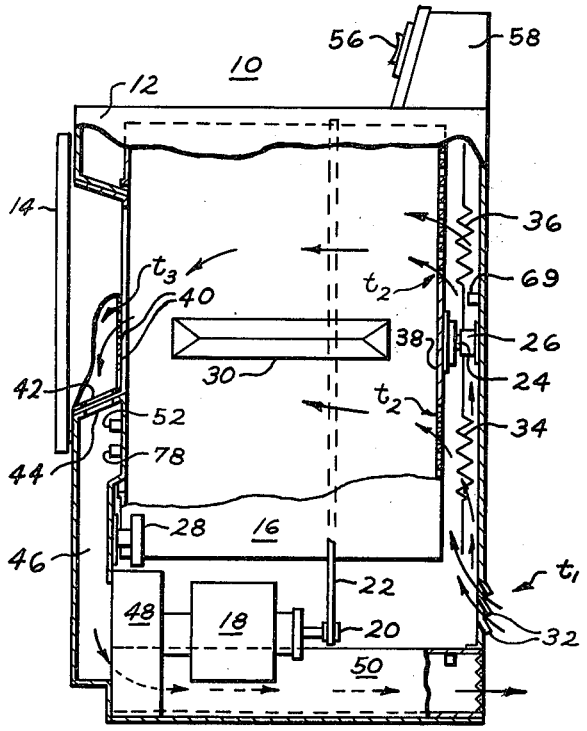
FIG. 1 is a side elevational view of a typical clothes dryer incorporating a preferred embodiment of the present invention, the view being partly in section.

Referring now to FIG. 1, there is shown a clothes dryer 10 of the domestic type which includes a cabinet 12 provided with a front door 14 for access into the interior of an enclosure within. The enclosure such as a drum 16 is rotatably mounted within the cabinet and provides a means for retaining fabrics such as clothes to be dried. An electric motor 18 is disposed within the cabinet generally adjacent to the drum 16. A pulley 20 at one end of the motor shaft is rotatably coupled to drum 16 by means of a drive belt 22. It will be understood by those skilled in the art that the speed or rotation of drum 16 is determined by the speed of motor 18 and the relative diameters of pulley 20 and drum 16.

The rear end of the drum is supported within the cabinet upon a stub shaft 24 which is disposed along the axis of the drum and is received in a stationary bearing 26 affixed to the rear portion of the cabinet 12. The front end of the drum is rotatably supported upon bearing means such as a pair of rollers as wheels, one of which is illustrated at 28. The wheels are rotatably mounted upon stub shafts or axles which are fixed to a front portion of cabinet 12 substantially parallel to the axis of rotation of drum 16. The drum is thus rotatably supported at one end by an axle shaft, at the other end by rollers so that it may be rotated by motor 18 for causing fabrics maintained therein to be agitated or tumbled in order to enhance the drying process. A plurality of clothes tumbling ribs 30 are provided upon the lateral wall of drum 16 to enable the fabrics to follow the lateral wall of the drum as it rotates upwardly, tumbling back down as the rib ascends further.

A flow of air for drying the fabrics within the drum is drawn from suitable air inlets such as louvers 32 at the rear of the cabinet and passed across first and second heating means such as first and second electrical resistance heaters 34 and 36, after which the heated air traverses openings 38 in the rear end of the drum and passes axially through the drum and through the clothes being tumbled therein. The air leaves the clothes and the enclosure by means of perforations 40 in an inner bulkhead of door 14 and passes by means of aligned openings 42 and 44 into an outlet duct 46 disposed within the front walls of the cabinet. A blower 48 rotatably driven by motor 18 impels the air drawn from duct 46 through an exhaust duct 50 and thence from the machine. This path of travel of the air has been shown by arrows.

It should be mentioned at this point that heaters 34 and 36 are, for the sake of simplicity, shown by schematic representation and might be, in accordance with common practice, a pair of varied diameter, electrical resistance heaters arranged concentrically about bearing 26 on the other wall of cabinet 12 for allowing air entering through louvers 32 to become heated as it passes across heaters 34 and 36, thence to inner drum 16 through the openings 38 on the rear portion thereof.

In accordance with the present invention, there is provided a protective control arrangement including control means such as a thermally responsive switch in the form of a bimetallic thermostat 52 arranged in duct 46, thereby to become activated when the air being exhausted through the duct 46 from drum 16 reaches a predetermined temperature.

For purposes of the present invention, thermostat 52 has been chosen to become activated, that is, to open or trip at 140° F and to become deactivated, that is, to reset or close at 120° F. Thermostat 52 then serves to effect de-energization of heater 34 when the temperature of the air in the outlet duct 46 reaches 140° F as will be hereinafter described.

Figure 2:
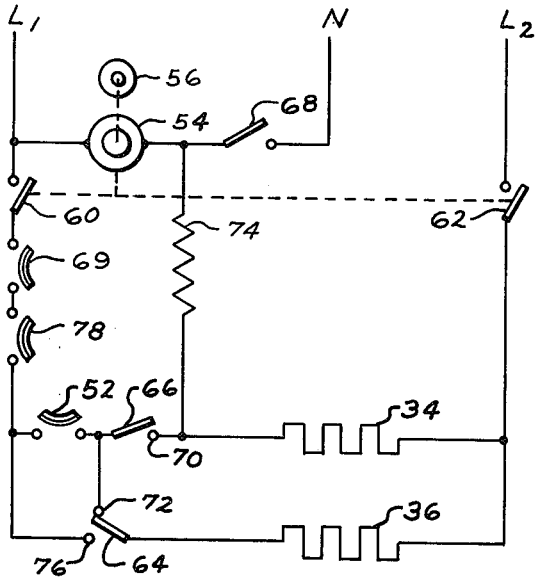
FIG. 2 is a schematic representation of a control arrangement for a clothes dryer useful in carrying out the present invention.

Referring now to FIGS. 1 and 2, there is shown by schematic representation an electrical circuit useful in the control arrangement of the present invention. Included are a pair of input terminals L1 and L2 adapted to be coupled to an energy source such as may typically be provided in a home and including 240 volts, AC, 60 Hz, single phase. Heaters 34 and 36 are coupled in parallel across terminals L1 and L2. A neutral terminal N is provided, there being then 120 volts AC between L1 and N and likewise between L2 and N, and 240 volts between L1 and L2.

Included in the circuit is a timer motor 54 arranged to be manually set into operation by a manually operable knob 56 normally located on a control panel 58 mounted atop cabinet 12 of the dryer. Timer motor 54 operates a sequence control device for providing at least one operational cycle for the drying of clothes in the dryer. This device includes a plurality of cam members (not shown) which serve to operate a plurality of switches causing the respective switches to open and close at predetermined times during an operational cycle. Means are provided such as a pair of switches 60 and 62 and, as shown in dotted lines, are responsive to operation of timer motor 54 to open and close the circuit to heaters 34 and 36 for energizing the heater circuit at the start of the cycle and for de-energizing the circuit at the end of the cycle. Control panel 58 also includes a series of manually operated control members (shown only in FIG. 2) one of which is a manually operable selector switch 64, as well as manually operable switches 66 and 68. Switch 68 serves to close the circuit between the timer motor and terminal N such that the timer motor 54 may be energized as would normally be the case in a typical timed-drying, operational cycle. A safety or high limit thermal switch, in the form of a thermostat 69 is provided mounted adjacent the heaters and on the back wall of cabinet 12 and serves as a protection to remove power from the heaters at a predetermined high temperature which may occur, for example, if blower 48 fails to operate properly. It should be mentioned at this point that certain other electrical components such as motor 18 not necessary to the explanation of this invention are omitted from the schematic representation of FIG. 2.

As is well known in the art, the manual operation of knob 56 serves to orient timer motor 54 and certain of the switches associated therewith such that the motor 18 will be energized thereby causing the drum 16 to rotate allowing the clothes therein to be tumbled and at the same time, to cause the operation of blower 48 to start the air flow through the dryer. Switches 60 and 62 then will be closed and in a typical drying operation wherein clothes made of certain fabrics such as cottons are to be dried, switch 66 will be manually closed to make contact with element 70 and switch 64 will be manually closed to make contact with element 72. With such an arrangement, then both heaters 34 and 36 will be energized and will remain in that state until thermostat 52 senses air in the exhaust duct 46 reaching a temperature of 140° F upon which time the thermostat 52 will open and heaters 34 and 36 will be de-energized. Heaters 34 and 36 have been chosen with a resistance of approximately 19 ohms each, each thereby being rated at approximately 2750 watts at 240 volts AC. A resistor 74 is provided in the circuit with a value of approximately 3770 ohms such that when heater 34 is de-energized, timer motor 54 will be energized across terminals L1 and L2 through heater 34. When the temperature in outlet duct 46 has dropped to 120° F, thermostat 52 will reset or close thereby allowing the re-energization of heaters 34 and 36 further stopping the operation of timer motor 54. This cyclical operation proceeds until the end of an operational cycle at which time switches 60 and 62 will be opened by timer 54 to remove power from heaters 34 and 36. In today's dryers, it is normally provided that the blower will continue to be energized however, for a few minutes after the removal of power from the heaters thereby allowing a cooldown within the dryer for preventing the forming the wrinkles in clothes which occurs at such operating temperatures.

Figure 3:
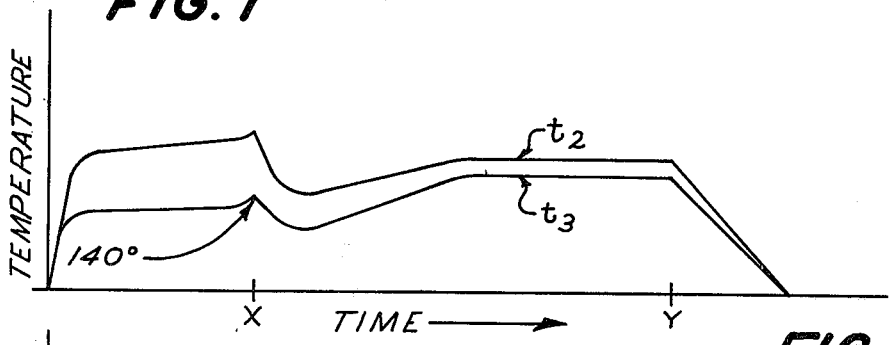
FIG. 3 is a graphical representation showing temperatures at various points within the dryer as a function of time during an operational cycle in a dryer wherein a preferred embodiment of the present invention is incorporated.
Figure 4:
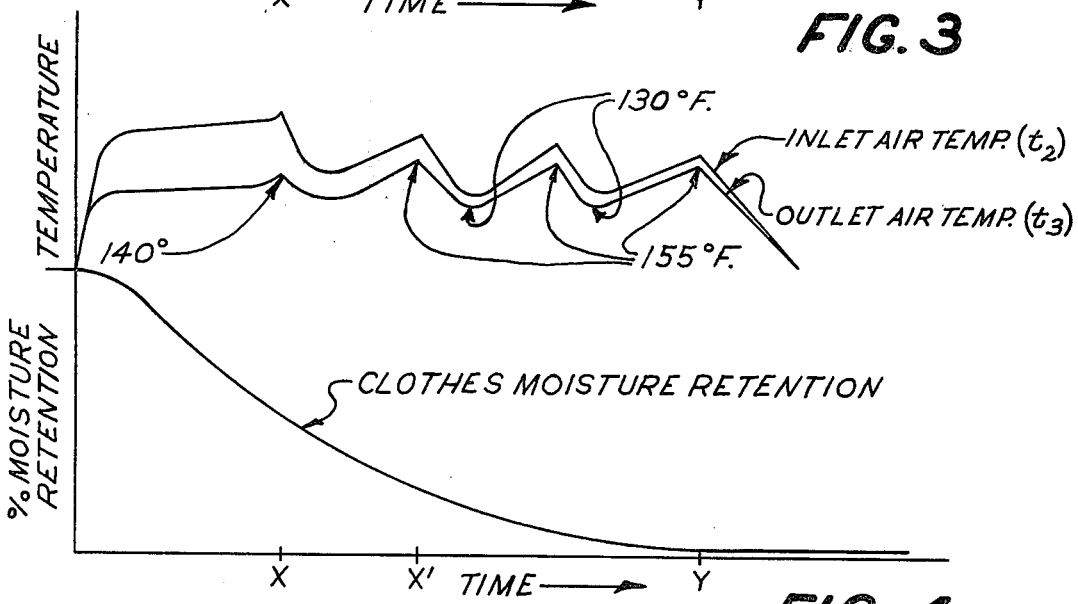
FIG. 4 is also a graphical representation of temperatures at various locations within the dryer as a function of time, and wherein is incorporated a preferred embodiment of the present invention in somewhat modified form.

By the present invention there is provided, in the circuit described above, a protective control arrangement for drying such fabrics as polyknits, modacrylics, and for preventing excessive heat that can damage these types of fabric. Some materials as polyknits are subject to damage as from shrinkage at temperatures in the vicinity of 250° F, and certain modacrylics suffer damage in the area of 225° F. In an arrangement where the ambient or inlet air temperature $t_1$ is approximately 80° F and both heaters 34 and 36 are energized at full heat, 5500 watts, and with an air flow of 90 CFM, the temperature of the air entering the back of the drum, $t_2$, can reach 320° F. It is obvious then that this temperature can produce damage to such fabrics as polyknits. However, as long as the clothes in the dryer have moisture content they will not experience any damage as their temperature is effectively limited to approximately 212° F. However, when most of the moisture has evaporated from the clothes as shown in the moisture retention curve in FIG. 4, their temperature starts to rise as does the temperature $t_3$ in the outlet duct 46. To preset the dryer controls for drying such fabrics, switch 64 is closed to make contact with element 76, switch 66 is closed to make contact with element 70, and switch 68 is left in the open position. With such an arrangement, at the start of the operational cycle, both switches 60 and 62 are closed as described above and both heaters 34 and 36 are energized across terminals L1 and L2. Referring now to FIG. 3, there appears a graph of temperature versus time showing how the protective control operates, the individual curves representing respectively, inlet air temperature $t_2$, and outlet air temperature $t_3$. As both heaters 34 and 36 are energized, thermal energy is introduced into the dryer at a high rate thereby providing, at the beginning of the cycle, a rather steep curve which then proceeds to level off somewhat. The temperatures ($t_2$ and $t_3$) then remain relatively steady but as the clothes load becomes dryer there is not sufficient moisture to cool the 320° F inlet air, thereby causing an increase in the drum outlet air temperature $t_3$. When the outlet temperature reaches 140° F at time X, thermostat 52 becomes activated to open causing heater 34 to become de-energized for the remainder of the cycle. With the same air flow and ambient inlet temperature as at the beginning but with only heater 36 energized, the temperature $t_2$ of the air entering the back of the drum is reduced to a maximum of approximately 225° F. Outlet temperature $t_3$ drops due to the drop in inlet temperature and then starts to increase, eventually to level off as the load becomes still dryer. If sufficient running time exists as provided by timer 54 now energized through resistor 74 and heater 34, the temperatures will rise and level off to approximate convergence, at which time Y the heating portion of the operational cycle has come to an end, the timer 54 causing switches 60 and 62 to become open thereby de-energizing heater 36, but allowing the blower to operate to provide a cool-off period.

An alternate arrangement provides a second control means such as second thermostatic control device, in the form of a second thermostat 78. Thermostat 78 has been chosen to become activated, that is, to open at 155° F and to become deactivated or closed at 130° F. Using such a second thermostat and providing a drying or operational cycle for polyknits, etc. as has just been described, that is, with switch 66 closed, switch 68 open and switch 64 contacting 76, we shall refer now to FIG. 4. With such an arrangement, heaters 34 and 36 are initially energized and so remain until outlet temperature $t_3$ reaches 140° F, at which time X the thermostat 52 opens thereby causing the de-energization of heater 34. Heater 34 then remains de-energized for the remainder of the cycle. Heater 36, however, remains energized and proceeds to supply thermal energy to the dryer. However, as the clothes become dryer, outlet air temperature $t_3$, as shown on the curve, begins to rise and when it reaches 155° F at time $X^1$, thermostat 78 opens thereby causing the de-energization of heater 36 also. As can be seen, the temperature then drops until it reaches 130° F, the point at which the thermostat 78 is deactivated or closed, and heater 36 is again energized. This periodical energization and de-energization of heater 36 continues for the remainder of the heating portion of the operational cycle, it being remembered that timer motor 54 has been energized through resistor 74 and heater 34 when thermostat 52 is open. At time Y, the end of the allotted time for the operational cycle, switches 60 and 62 responsive to timer 54 are opened thereby removing power from the heater portion of the circuit whereupon the blower continues operation to effect cool-down within the dryer. It will be noticed that thermostat 52 never does reset since thermostat 78 has been chosen to have a higher reset temperature, i.e., 130° F versus 120° F for thermostat 52.

It will be appreciated by the foregoing discussion that what has been provided is a simplified but efficient protective control arrangement for a clothes dryer especially useful when such fabrics as polyknits are to be dried therein. It will be understood, however, that such a control arrangement is not limited to a system wherein electrical resistance heaters are used. For example, those skilled in the art will certainly recognize that the thermal energy may be provided by first and second gas burners including first and second electrically operated valves respectively, the valves being coupled in parallel across the input terminals L1 and L2 much as are heaters 34 and 36. With such an arrangement then, rather than modulate a given gas burner, upon the reaching of a given temperature one of the gas burners would be totally de-energized thereby leaving only one of the burners to supply the thermal energy for the rest of the operational cycle. In a case where a second thermostat is used, upon the initial de-energization of the first gas burner, the second gas burner would be periodically cycled on and off in response to operation of the second thermostat much as in the case of the use of electrical resistance heaters as described above.

It should be mentioned that the electrical resistance heaters 34 and 36 have been chosen of equal value, that is, to use approximately 2750 watts each at 240 volts. It is certainly possible to vary these values; for example, one heater may be 2000 watts while the other is 3500 watts, or any other desired values. The choice of values of these heating elements depends in part upon the velocity of air flow through the dryer and, for example, the blower might be arranged to supply a higher velocity of air flow for such a 3500 watt heater after initial tripping of the 140° F thermostat 52. Furthermore, thermostats of different trip and reset values may be found necessary in order to accord the protection necessary when using such a heater arrangement. Of course, various combinations of values of heater output, thermostat trip and reset temperatures and air flow velocity may be prescribed to provide many and varying heating cycles and results.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. In a clothes dryer providing at least one timer controlled operational cycle for the drying of clothes placed therein, a protective control arrangement comprising:

first and second heating means in the dryer, both energized at the start of the cycle for supplying thermal energy to the dryer for effecting drying of clothes placed in the dryer; and control means in the dryer arranged such that, upon the reaching of a predetermined temperature therein, the control means will become activated to always effect de-energization of the first heating means for the remainder of the cycle while the second heating means remains continuously energized for the complete cycle, thereby effecting a reduction of rate of supply of thermal energy to the dryer.

2. The control arrangement of claim 1 further comprising:

means for energizing both first and second heating means at the start of the cycle and for deenergizing the second heating means at the end of the cycle.

3. The control arrangement of claim 1 wherein the first and second heating means are first and second electrical resistance heaters and the control means is a thermostatic control device responsive to the temperature of air being exhausted from the dryer for activation and deactivation.

4. The control arrangement of claim 3 wherein the electrical resistance heaters are coupled in parallel across first and second input terminals adapted to be coupled to an energy source, the thermostatic control device being coupled serially with the first heater.

5. The control arrangement of claim 1 wherein the first and second heating means are first and second gas burners including first and second electrically operated valves respectively and the control means is a thermostatic control device responsive to the temperature of air being exhausted from the dryer for activation and deactivation.

6. The control arrangement of claim 5 wherein the first and second electrically operated valves are coupled in parallel across a pair of input terminals adapted to be coupled to an energy source, the thermostatic control device being coupled serially with the first electrically operated valve.

* * * * *